US006684854B2

(12) United States Patent
Coldren et al.

(10) Patent No.: US 6,684,854 B2
(45) Date of Patent: Feb. 3, 2004

(54) AUXILIARY SYSTEMS FOR AN ENGINE HAVING TWO ELECTRICAL ACTUATORS ON A SINGLE CIRCUIT

(75) Inventors: Dana R. Coldren, Fairbury, IL (US); Stephen R. Lewis, Minonk, IL (US); Glen F. Forck, Peoria, IL (US); Michael R. Huffman, Pontiac, IL (US); Matthew A. Bredesen, Chicago, IL (US)

(73) Assignee: Caterpillar Inc, Peoria, IL (US)

( * ) Notice: Subject to any disclaimer, the term of this patent is extended or adjusted under 35 U.S.C. 154(b) by 84 days.

(21) Appl. No.: 10/023,272

(22) Filed: Dec. 14, 2001

(65) Prior Publication Data

US 2003/0111061 A1 Jun. 19, 2003

(51) Int. Cl.[7] ..... F02M 37/04; B05B 1/30

(52) U.S. Cl. ..... 123/446; 123/458; 251/129.1; 239/585.1

(58) Field of Search ..... 123/446, 506, 123/467, 458, 90.12; 251/129.09, 129.1; 239/585.1–585.5, 88, 90, 92–96

(56) References Cited

U.S. PATENT DOCUMENTS

| | | | | |
|---|---|---|---|---|
| 2,798,769 | A | | 7/1957 | Whitson |
| 2,852,308 | A | | 9/1958 | Whitson |
| 4,238,813 | A | | 12/1980 | Carp et al. |
| 4,688,536 | A | | 8/1987 | Mitsuyasu et al. |
| 4,764,840 | A | | 8/1988 | Petrie et al. |
| 4,807,811 | A | | 2/1989 | Aketa et al. |
| 4,811,899 | A | | 3/1989 | Egler |
| 4,950,974 | A | | 8/1990 | Pagano |
| 4,993,637 | A | | 2/1991 | Kanesaka |
| 5,277,163 | A | | 1/1994 | Ohishi |
| 5,335,136 | A | | 8/1994 | Locher et al. |
| 5,460,329 | A | | 10/1995 | Sturman |
| 5,494,219 | A | | 2/1996 | Maley et al. |
| 5,622,152 | A | * | 4/1997 | Ishida ..... 123/446 |
| 5,669,355 | A | | 9/1997 | Gibson et al. |
| 5,671,715 | A | | 9/1997 | Tsuzuki |
| 5,694,903 | A | | 12/1997 | Ganser |
| 5,697,342 | A | | 12/1997 | Anderson et al. |
| 5,701,870 | A | | 12/1997 | Gottshall et al. |
| 5,720,261 | A | | 2/1998 | Sturman et al. |
| 5,823,429 | A | | 10/1998 | Beck et al. |
| 5,825,216 | A | | 10/1998 | Archer et al. |
| 5,839,661 | A | | 11/1998 | Iwanaga |
| 5,862,792 | A | * | 1/1999 | Paul et al. ..... 123/446 |
| 5,862,793 | A | | 1/1999 | Jay et al. |
| 5,884,896 | A | | 3/1999 | Kono et al. |
| 5,893,350 | A | | 4/1999 | Timms |
| 5,899,436 | A | | 5/1999 | Holmes et al. |
| 5,915,624 | A | | 6/1999 | Coldren et al. |
| 5,954,030 | A | | 9/1999 | Sturman et al. |
| 5,957,381 | A | | 9/1999 | Wakamatsu et al. |

(List continued on next page.)

FOREIGN PATENT DOCUMENTS

| | | |
|---|---|---|
| GB | 2339077 | 1/2000 |

*Primary Examiner*—Carl S. Miller
(74) *Attorney, Agent, or Firm*—Liell & McNeil

(57) ABSTRACT

An engine is provided comprising an engine housing defining at housing and has a different portion associated with each engine cylinder. Each different portion of the engine auxiliary system has a first electrical actuator coupled to a first valve and a second electrical actuator coupled to a second valve which are wired in series. For example, a fuel injection system is provided with a first electrical actuator operably coupled to a fuel pressurizer and a second electrical actuator operably coupled to a direct control needle valve. The electrical actuators are wired in series on an electrical circuit. A method of controlling a portion of the engine auxiliary system is also provided which consists of actuating a first electrical actuator with a relatively low current and actuating a second electrical actuator with a relatively high current.

20 Claims, 4 Drawing Sheets

U.S. PATENT DOCUMENTS 5,986,871 A 11/1999 Forck et al.
6,005,763 A 12/1999 North
6,012,644 A 1/2000 Sturman et al.
6,024,296 A 2/2000 Wear et al.
6,024,297 A 2/2000 Greeves
6,027,037 A 2/2000 Murakami et al.
6,029,628 A 2/2000 Oleksiewicz et al.
6,044,823 A 4/2000 Watanabe
6,062,489 A 5/2000 Tokumaru
6,065,684 A 5/2000 Varble et al.
6,073,862 A 6/2000 Touchette et al.
6,076,508 A 6/2000 Nakano
6,079,641 A 6/2000 Shinogle et al.
6,113,014 A 9/2000 Coldren et al.
6,392,865 B1 * 5/2002 Fochtman et al. ..... 361/160

* cited by examiner

AUXILIARY SYSTEMS FOR AN ENGINE HAVING TWO ELECTRICAL ACTUATORS ON A SINGLE CIRCUIT

TECHNICAL FIELD

The present invention relates generally to auxiliary engine systems, and more particularly to such a system with two electrical actuators arranged in series on an electrical circuit.

BACKGROUND

Many electromechanical devices, including some fuel injectors, utilize two or more separate electrical actuators. This design offers numerous advantages over systems utilizing a single electrical actuator. Multiple actuator injection schemes enhance the potential control over valve actuation, allowing injection timing and duration, and fuel pressurization to be precisely controlled. In many cases, however, the additional hardware and circuitry necessary for a second actuator make its use cost-prohibitive. Moreover, system robustness and long term reliability may be compromised.

U.S. Pat. No. 6,113,014 to Coldren et al. discloses one method of incorporating a second electrical actuator into a fuel injector by wiring the solenoids in series. The use of a plurality of diodes in the circuit allows the solenoids to be selectively actuated, while avoiding the financial and functional problems associated with additional wiring and hardware. The Coldren design represents one successful way of addressing the problem, however, there is always room for improvement.

The present invention is directed to one or more of the problems associated with the prior art.

SUMMARY OF INVENTION

In one aspect, an engine is provided which comprises an engine housing defining at least one cylinder. At least one engine auxiliary system is attached to the engine housing and has a different portion associated with each of the at least one cylinder. Each different portion includes a first electrical actuator operably coupled to a first valve, and a second electrical actuator operably coupled to a second valve. An electrical circuit is associated with each of the at least one cylinder. In addition, the first electrical actuator and the second electrical actuator are arranged in series on the electrical circuit and are actuatable at a low current level and a high current level, respectively.

In another aspect, a fuel injection system is provided which comprises at least one body component, a first electrical actuator that is operably coupled to a fuel pressurizer, and a second electrical actuator that is operably coupled to a direct control needle valve. The first electrical actuator and the second electrical actuator are arranged in series on an electrical circuit and are actuatable at a low current level and a high current level, respectively. The first electrical actuator, the fuel pressurizer, the second electrical actuator, and the direct control needle valve are attached to the at least one body component.

In still another aspect, a method of controlling a portion of at least one engine auxiliary system associated with each engine cylinder is provided. The method includes the step of arranging a first electrical actuator and a second electrical actuator in series on an electrical circuit associated with each engine cylinder. The method also includes the step of actuating the first electrical actuator without actuating the second electrical actuator at least in part by establishing a relatively low current level in the electrical circuit. The method also includes the step of actuating the second electrical actuator at least in part by establishing a relatively high current level in the electrical circuit.

DETAILED DESCRIPTION

Figure 1:
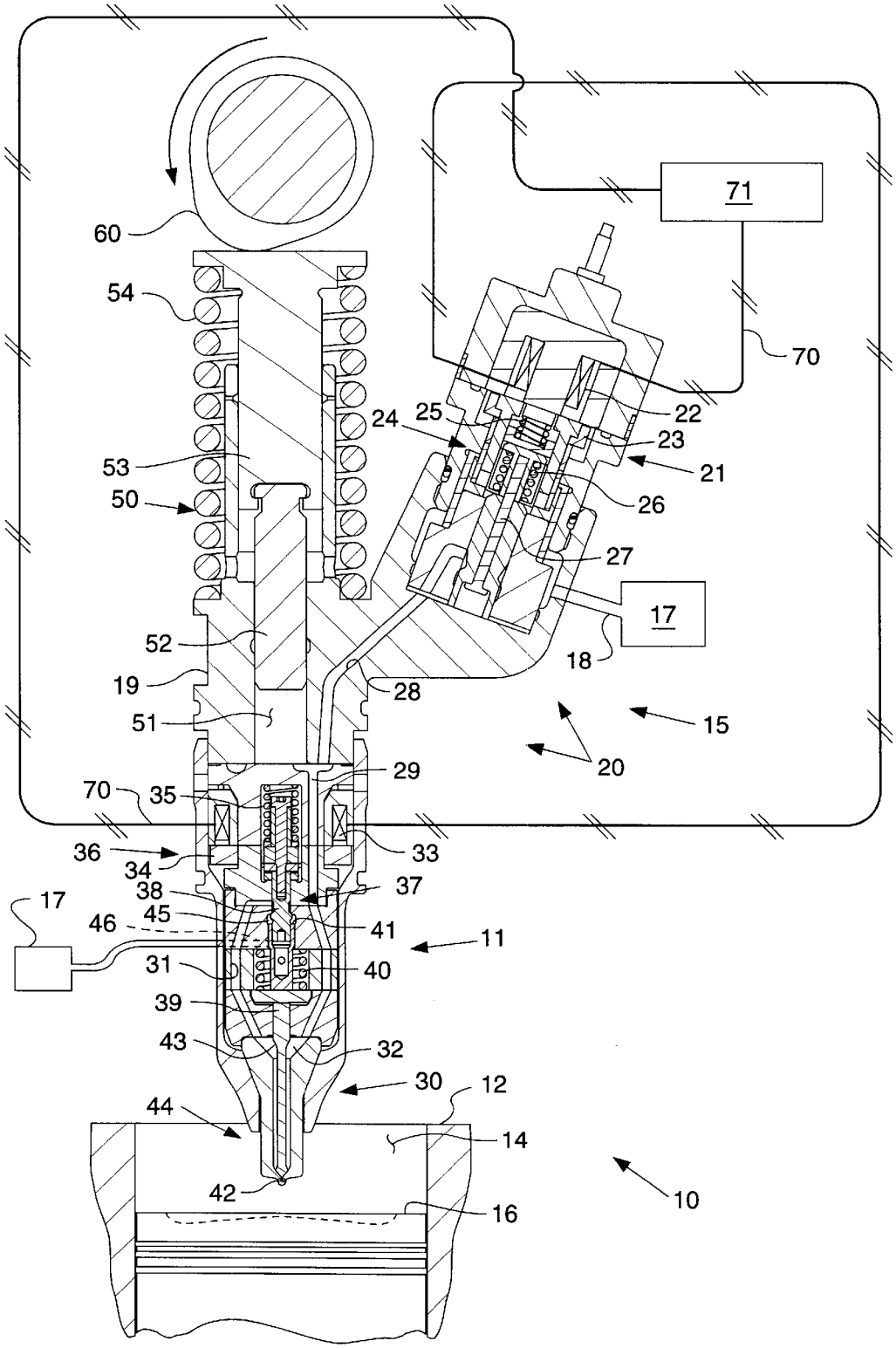
FIG. 1 is a partial side diagrammatic view of an engine according to the preferred embodiment of the present invention.

Referring to FIG. 1, there is shown an engine 10 according to the preferred embodiment of the present invention. Engine 10 includes an engine housing 12 that defines at least one cylinder 14, within which a reciprocating piston 16 is positioned. Engine 10 also includes a cam 60 which is operably coupled to a fuel pressurizer 50 that is preferably attached to a mechanically-actuated fuel injector 11 that has an injector body 19. A direct control needle valve 30 is positioned within injector body 19. A fuel supply 17 is provided and supplies low pressure fuel to injector 11 via a spill passage 18. Engine 10 further provides an electronic control module 71 and an electrical circuit 70 that is associated with each of engine 10's cylinders 14. Engine 10 also includes at least one engine auxiliary system 20, which in this case is a fuel injection system 15, that is attached to housing 12 and has a different portion associated with each cylinder 14. The term "auxiliary system" is intended to refer to fuel injection systems, gas exchange valves, engine brakes, EGR actuators, etc. that typically have individual portions associated with each engine cylinder.

Each portion of auxiliary system 20, which in this example is fuel injection system 15, includes a first electrical actuator 21 which is operably coupled to a first valve 24 that is a flow control valve, and a second electrical actuator 36 operably coupled to a second valve 37, which is part of a direct control needle valve 30. Electrical actuators 21 and 36 are preferably solenoid actuators, although it should be appreciated that some other device such as a piezoelectric actuator, a voice coil, etc. might be employed. First electrical actuator 21 and second electrical actuator 36 should be arranged in series on electrical circuit 70, and are preferably actuatable at a low current level and a high current level, respectively. In the preferred embodiment, engine auxiliary system 20 includes a fuel injection system 15, although it should be appreciated that additional engine systems might be incorporated with engine auxiliary system 20. For instance, an engine brake, power steering, or some other system might be added to engine 10 or substituted for fuel injection system 15 without departing from the scope of the invention. In the preferred embodiment, fuel injection system 15 includes a plurality of mechanically-actuated fuel injectors 11, each defining a fuel pressurization chamber 51. The rotation of cam 60 drives a plunger 52 down to pressurize fuel in chamber 51, while the action of a biasing spring 54 can return plunger 52 to its up position between pressurization strokes. Plunger 52 is operably coupled to cam 60 with a tappet 53.

In the preferred embodiment, first valve 24 is a spill valve and is a portion of fuel pressurizer 50. First valve 24 is preferably attached as a side car to injector body 19 and includes electrical actuator 21 which is comprised of a solenoid coil 22 and an armature 23. Solenoid coil 22 is connected to electrical circuit 70, and can thus be supplied with current when desired in a conventional manner as commanded by electronic control module 71. Electrical actuator 21 is preferably actuatable at a relatively low current level. First valve 24 also includes a valve member 27 that is coupled to armature 23 by a biasing spring 26. Armature 23 and valve member 27 are movable between an up and a down position by energizing or de-energizing electrical actuator 21. A biasing spring 25 biases armature 23 and thus valve member 27 toward the down position when electrical actuator 21 is de-energized. It should be appreciated that the strength of biasing spring 25 should be such that the force it exerts on armature 23 and thus valve member 27 is sufficient to hold valve member 27 in its down position when the actuator is not energized. Biasing spring 26 should be such that it will assist movement of valve member 27 toward its down position relatively rapidly, when electrical actuator 21 is de-energized. In its down position, valve member 27 allows fluid communication between low pressure spill passage 18 and a fluid supply conduit 28. Fluid supply conduit 28 is fluidly connected to pressurization chamber 51 which is defined in part by a valve body 19 and in part by plunger 52.

Fluid supply conduit 28 is also in fluid communication with needle control valve 30 via a nozzle supply passage 29. In the preferred embodiment, second valve 37 is a portion of needle control valve 30. Supply passage 29 is connected to a nozzle chamber 32 that can be opened to cylinder 14 via a set of nozzle outlets 42. Nozzle chamber 32 also connects to a needle control passage 31. A needle control valve member 38 is movably positioned within injector body 19 and separates needle control passage 31 from a needle control chamber 45. Second electrical actuator 36 includes a coil 33 and an armature 34 that is preferably coupled to needle control valve member 38. Coil 33 is connected to electrical circuit 70, and can be energized by command from electronic control module 71 by providing a relatively high level of current. A biasing spring 35 biases needle control valve member 38 toward a down position in which it provides fluid communication between needle control passage 31 and needle control chamber 45. When valve member 38 is moved to an up position by activating actuator 36, it blocks fluid communication between needle control chamber 45 and passage 31. When in this position, needle control chamber 45 is fluidly connected to a low pressure vent passage 46 via a leakage clearance.

A needle valve member 39 is positioned within injector body 19 and is movable between an open (up) position in which nozzle outlets 42 are open, and a shut (down) position in which they are blocked. Because injector 11 has an injector tip 44 which preferably extends into cylinder 14, when needle valve member 39 is in its up position, pressurized fuel in nozzle chamber 32 can spray out of nozzle outlets 42 into cylinder 14. When needle valve member 39 is in its down position, fuel spray cannot occur. Needle valve member 39 has a closing hydraulic surface 41 which is exposed to fluid pressure in needle control chamber 45, and an opening hydraulic surface 43 which is exposed to fluid pressure in nozzle chamber 32. A biasing spring 40 is operably positioned to bias needle valve member 39 toward its shut/down position. It should be appreciated that the relative sizes of needle valve member 39's hydraulic surfaces 41 and 43, the flow area provided by needle control valve member 38, and the strength of biasing spring 40 should be such that the hydraulic force on opening hydraulic surface 43 will move needle valve member 39 to its open position very shortly after electrical actuator 36 moves needle control valve member 38 to its up position. Similarly, the various components should be engineered such that needle valve member 39 can be moved to its shut position, halting fuel spray, relatively quickly when the termination of an injection event is desired, even in the presence of high pressure fuel acting on opening hydraulic surface 43.

Figure 2:
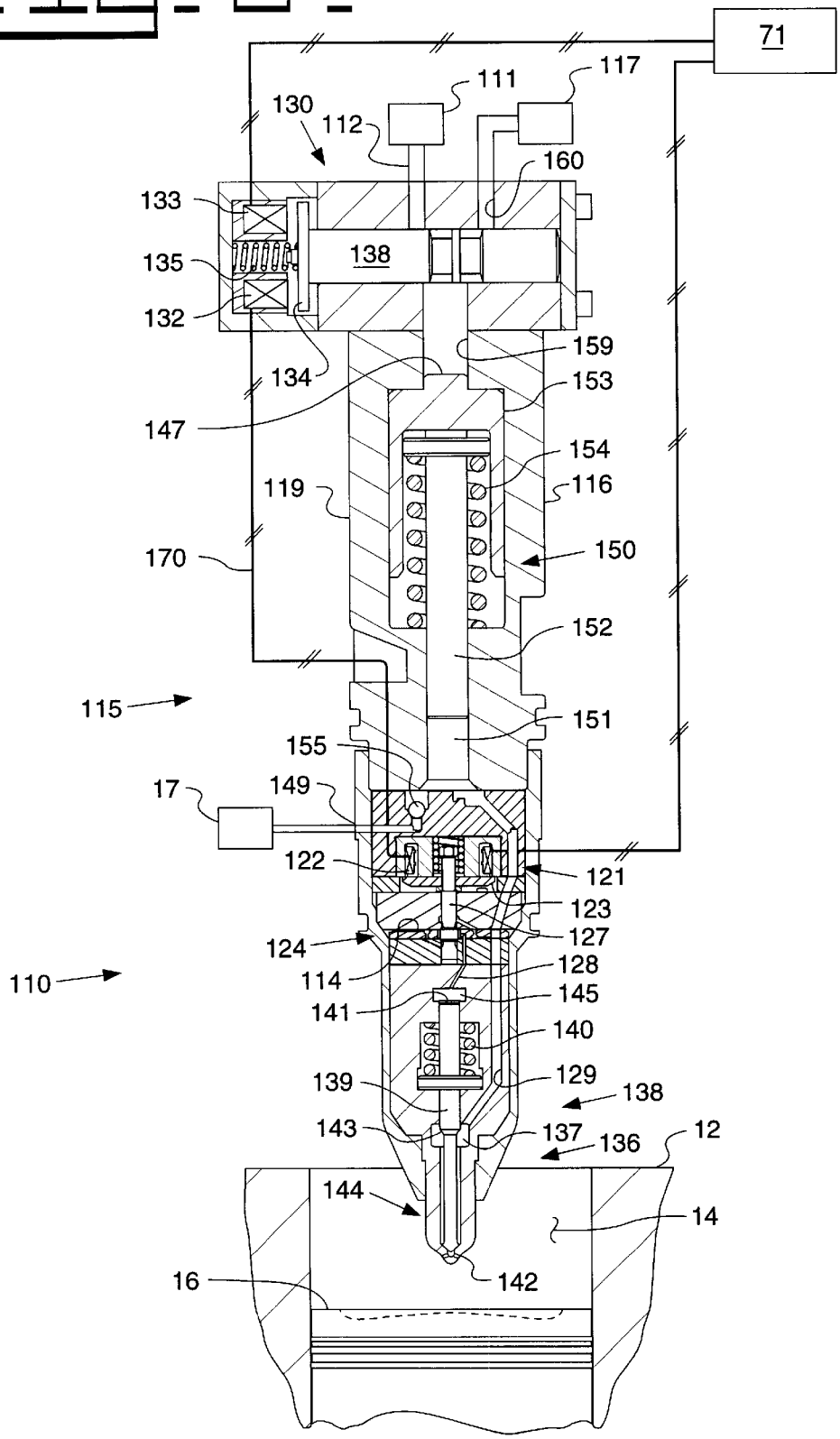
FIG. 2 is a partial side diagrammatic view of an engine according to a second embodiment of the present invention.

Referring to FIG. 2, there is shown an engine 110 representing a second embodiment of the present invention. This second embodiment is similar in many ways to the preferred embodiment illustrated in FIG. 1, yet has a number of significant differences. Rather than a mechanically-actuated fuel injector, engine 110 includes at least one hydraulically actuated fuel injector 116 with an intensifier piston 153. Hydraulically actuated injector 116 provides a valve body 119. Similar to engine 10, engine 110 also includes an engine housing 12, cylinder 14, and piston 16. An injector tip 144 preferably extends into cylinder 14. A high pressure hydraulic fluid supply 111 is provided, and a low pressure fuel supply 17. Engine 110 preferably uses engine lubricating oil as hydraulic fluid, however, it should be appreciated that transmission, brake, coolant, or some other suitable engine fluid might be used. A first valve 130 and a second valve 124 have been illustrated as being parts of separate fluid circuits, but could be modified to share a common hydraulic supply. A fuel pressurizer 150 is positioned within the injector body 119 and includes a piston 153 and plunger 152. A direct control needle valve 138 is also housed within the injector body 119. An electronic control module 71 is provided and is connected to an electrical circuit 170. Engine 110 also includes a fuel injection system 115, that is an engine auxiliary system, that is preferably attached to engine housing 12.

Fuel injection system 115 provides a first electrical actuator 132 that is operably coupled to first valve 130, which is preferably a flow control valve and is operable to control fluid flow to intensifier piston 153. Fuel injection system 115 also includes a second electrical actuator 121 that is operably coupled to second valve 124. Electrical actuators 121 and 132 are illustrated as solenoid actuators, however, it should be appreciated that another appropriate actuator such as a piezoelectric actuator might be substituted without departing from the scope of the present invention. In a manner similar to the preferred embodiment, first electrical actuator 132 is preferably actuatable at a relatively low current level, whereas second electrical actuator 121 is preferably actuatable at a relatively high current level.

High pressure supply 111, which could be a common rail, supplies high pressure fluid to first valve 130 via a high pressure passage 112. First electrical actuator 132 controls the state of flow control valve 130 and includes a solenoid coil 133 and an armature 134. Armature 134 is connected to a valve member 138 and is movable between a left and a right position by energizing and de-energizing electrical actuator 132. Valve member 138 has been illustrated as a spool valve member, however, it should be appreciated that some other suitable valve type such as a poppet or ball and pin might be substituted. A biasing spring biases poppet valve member 138 toward its right position. When valve member 138 is in its right position, high pressure passage 112 is blocked, but drain 117 in fluid communication with a pressure control passage 159. In other words, spool valve member 138 provides fluid communication between pressure communication passage 156 and a low pressure drain 160. When spool valve member 138 is moved toward its left position by energizing electrical actuator 132, pressure control passage 159 is blocked to drain 160, but opened to high pressure supply 112.

As spool valve member 138 moves toward its left position, it opens fluid communication between passage 112 and pressure communication passage 159, which fluidly connects to fuel pressurizer 150. Fuel pressurizer 150 includes piston 153 and plunger 152 which are movable between an up position and a down position. A biasing spring 154 biases piston 153 and plunger 152 toward their up position. When fluid pressure is communicated to piston 152 via pressure communication passage 159, piston 153 and plunger 152 are forced down, overcoming the force of biasing spring 154 to pressurize fuel in a fuel pressurization chamber 151. After an injection event, piston 153 and plunger 152 can be moved back toward their retracted (up) position by the action of biasing spring 154, drawing fuel into fuel pressurization chamber 151 via an inlet 149 from fuel supply 17. As plunger 152 retracts, hydraulic fluid can be drained past spool 126 to a low pressure drain 117 via drain passage 160.

Second electrical actuator 121 includes a coil 122 which is connected to electrical circuit 170, and an armature 123 that is connected to a second valve 124 that includes a flow control valve member 127 which is movable between an up and a down position. A biasing spring 125 biases armature 123 and hence valve member 127 toward their down position, in which a nozzle supply line 129 can supply high pressure fluid from fuel pressurization chamber 151. When actuator 121 is energized, and valve member 127 is moved toward its up position, fluid communication between nozzle supply line 129 and needle control chamber 145, which is blocked, which becomes fluidly connected to a low pressure vent passage 114 via needle control passage 128. Valve member 127 has been illustrated as a poppet valve, however, it should be appreciate that some other suitable valve type such as a spool or ball and pin might be substituted without departing from the scope of the present invention.

Needle control passage 128 is in fluid communication with a needle control chamber 145. A closing hydraulic surface 141 of a needle valve member 139 is exposed to fluid pressure in needle control chamber 145. Thus, either high pressure or low pressure may be provided to needle control chamber 145 by energizing or de-energizing actuator 121 to move valve member 127 between its respective positions. A biasing spring 140 biases needle valve member 139 toward its down position in which it closes a set of nozzle outlets 142.

Fuel pressurized by the action of fuel pressurizer 150 is communicated to a nozzle chamber 137 via a nozzle supply passage 129. Inside nozzle chamber 137, the pressurized fuel can act on opening hydraulic surface 143 of needle valve member 139 to push needle valve member 139 up, opening nozzle outlets 142 and allowing fuel to spray into cylinder 14. It should be appreciated that the sizing of needle valve member 139's hydraulic surfaces 141 and 143, and the strength of biasing spring 140 should be such that the increase in fuel pressure inside nozzle chamber 137 that results from the action of fuel pressurizer 150 is sufficient to lift needle valve member 139 away from nozzle outlets 142 when injection is desired. It is also desirable for needle valve member 139 to close nozzle outlets 142 relatively rapidly when termination of injection is desired.

Figure 3:
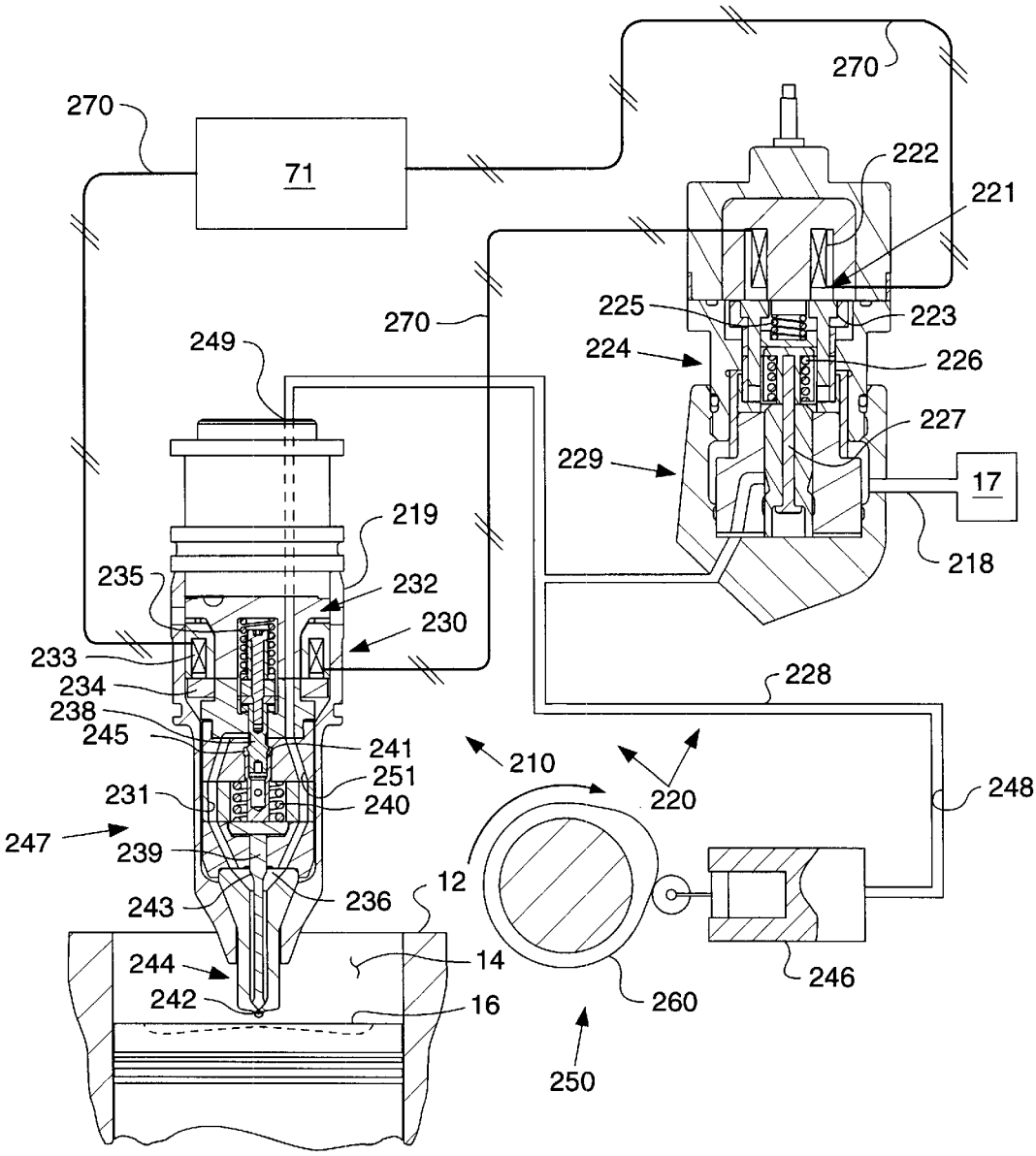
FIG. 3 is a partial side diagrammatic view of an engine according to a third embodiment of the present invention.

Referring to FIG. 3, there is shown an engine 210 representing a third embodiment of the present invention. Engine 210 includes a housing 12 defining a cylinder 14, and a piston 16 which is preferably positioned partially within cylinder 14. Engine 210 also provides an engine auxiliary system 220 which is preferably a pump and line fuel injection system which includes a spill valve assembly 229 and a nozzle assembly 230. A direct operated needle valve 247 is provided which is a portion of nozzle assembly 230. Nozzle assembly 230 includes a tip 244 which is preferably positioned partially within cylinder 14. Engine 210 further provides a fuel pressurizer 250 that includes a unit pump 246 that is separated from nozzle assembly 230, and is preferably operably coupled to a cam 260. An electronic control module 71 is provided and includes a current generator connected to an electrical circuit 270.

Electrical circuit 270 connects electronic control module 71 to a first electrical actuator 221 and a second electrical actuator 232 in series. First electrical actuator 221 includes a coil 222 and an armature 223 and is operably coupled to a first valve 224. Energizing and de-energizing electrical actuator 221 moves armature 223 between a down and an up position. A biasing spring 225 biases armature 223 toward its down position. First valve 224, which is preferably a spill valve, includes a valve member 227 that is movable between an up and a down position, and functions in a manner similar to that described with respect to spill valve 21 illustrated in FIG. 1. A second biasing spring 226 assists in movement of valve member 227 toward its down position when the solenoid is de-energized. The force of biasing spring 225 preferably holds armature 223 and valve member 227 in their down positions, when electrical actuator 221 is de-energized. In this position, valve member 227 provides fluid communication between a spill passage 218 and an engine fuel tank 17. When electrical actuator 221 is energized, and valve member 227 is moved to its up position, fluid communication between spill passage 218 and fuel tank 17 is blocked. Thus, fluid supplied to first valve 224 can flow to fuel tank 17 when electrical actuator 221 is de-energized, but does not when electrical actuator 222 is energized.

Spill passage 218 fluidly connects to a pump passage 248 and a fluid supply conduit 228. Pump passage 248 fluidly connects to unit pump 246 and is supplied with pressurized fuel by unit pump 246's pumping action. Fluid supply conduit 228 is connected to nozzle assembly 230 via an inlet 249. A nozzle supply passage 251 defined by valve body 219 supplies fluid via inlet 249 to a nozzle chamber 236. Nozzle chamber 236 in turn fluidly connects to a needle control passage 231 which can supply pressurized fluid to a needle control chamber 245. Second electrical actuator 232 is positioned within valve body 219 and includes a coil 233 and an armature 234, and is preferably actuatable at a relatively high current level. Armature 234 is connected to a needle control valve member 238 and is movable between an up and a down position, regulating the fluid pressure supplied to needle control chamber 245 in a manner similar to the FIG. 1 embodiment. A biasing spring 240 is positioned to bias needle valve member 239 down to shut nozzle outlets 242. Opening hydraulic surface 243 and a closing hydraulic surface 241 serve an analogous purpose to hydraulic surfaces 41 and 43 which were described with regard to the present invention's FIG. 1 embodiment.

Industrial Applicability

Referring to FIG. 1, there is shown the preferred embodiment of the present invention with its various components in the positions they would occupy between injection events. Cam 60 is continuously rotating, driving plunger 52 down to pressurize fuel in pressurization chamber 51. Return spring 54 pushes valve member 52 back toward its retracted position, drawing fuel into pressurization chamber 52 from fuel supply 17 between pressurization strokes. Electrical actuator 21 is de-energized, and valve member 27 allows fluid communication between fluid supply conduit 28 and fuel tank 17. Pressurized fuel from pressurization chamber 51 can thus flow via flow control valve 24 to fuel tank 17 for re-circulation. Electrical actuator 36 is also de-energized, and needle control valve member 38 is in its down position where it provides fluid communication between needle control passage 31 and needle control chamber 45. Fluid pressurized from the action of fuel pressurizer 50 is supplied via nozzle supply passage 29 and nozzle chamber 32 to needle control passage 31. The force of biasing spring 40 and the hydraulic force on needle closing hydraulic surface 41 in chamber 45 combine to hold needle valve member 39 in its down position, closing nozzle outlets 42.

Figure 4A:
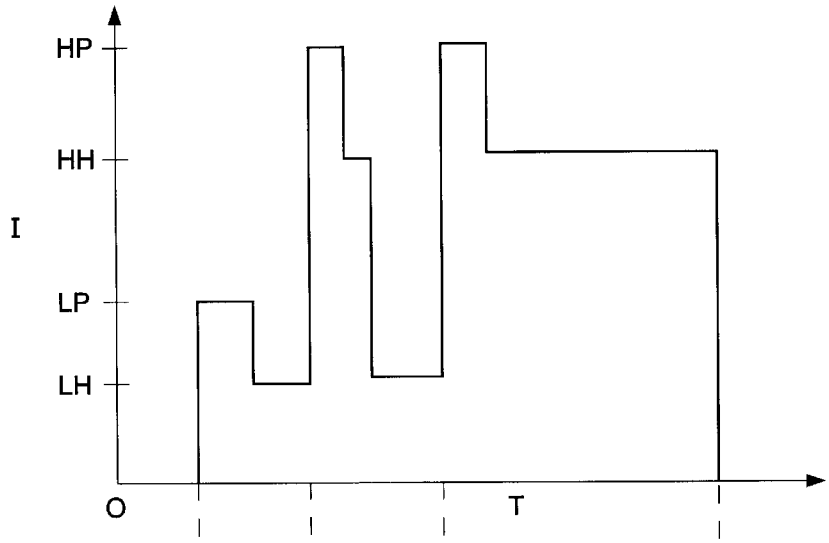
FIGS. 4*a* and 4*b* are graphs representing the current level and injection mass flow rate versus time, respectively, for an injection event according to the present invention.
Figure 4B:
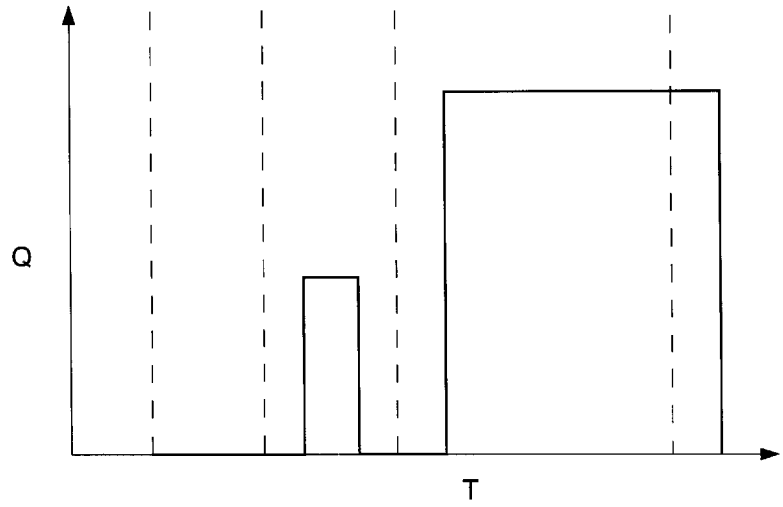

Between injection events, no current is supplied to electrical circuit 70. Referring now in addition to FIGS. 4*a* and 4*b*, a sample split injection event is illustrated. When initiation of a fuel injection event is desired, a relatively low pull in current level (LP) is established in electrical circuit 70 with electronic control module 71 to actuate first electrical actuator 21 without actuating second electrical actuator 36. When first electrical actuator 21 is energized, armature 23 is pulled toward coil 22, overcoming the force of biasing spring 25. As armature 23 moves up, fluid communication between fluid supply conduit 28 and fuel tank 17 becomes blocked. A relatively greater current level is necessary to move armature 23 to its up position than that necessary to hold armature 23 in its up position. Thus, once electrical actuator 21 has been energized for a time sufficient to move armature 23 and valve member 27 to the up position, the current level may be reduced to a low hold level (LH), significantly reducing energy expenditure. Because second electrical actuator 36 remains stationary, since it is not sufficiently energized to overcome the preload of spring 35, the hydraulic pressure can increase to an injection pressure in fuel pressurization chamber 51, nozzle chamber 32, and needle control chamber 45 as well as passages 29 and 31 which connect the respective chambers. Consequently, the hydraulic force on needle closing hydraulic surface 41 and the force of biasing spring 40 remain sufficient to overcome the force on needle opening hydraulic surface 43, and needle valve member 39 is held in its down position, blocking nozzle outlets 42.

Just prior to the moment that injection is desired, the current in electrical circuit 70 is increased to a high pull-in level (HP) which is relatively higher than the pull-in level necessary to actuate first electrical actuator 21, and sufficient to actuate electrical actuator 36. When electrical actuator 36 is thus energized, armature 34 and needle control valve member 38 begin to move toward the up position in which fluid communication between needle control passage 31 and needle control chamber 45 is blocked. In a manner similar to first electrical actuator 21, the high hold current (HH) for electrical actuator 36 is less than the pull in current, and the current level may be reduced once armature 34 and valve member 38 reach their upper position. In the preferred embodiment, the high pressure fuel in needle control chamber 45 bleeds through a controlled leak clearance with valve body 19, allowing pressure to drop in needle control chamber 45 when fluid communication with needle control passage 31 is blocked. The hydraulic pressure acting on opening hydraulic surface 43 becomes sufficient to lift needle valve member 39 to open nozzle outlets 42, allowing fuel from nozzle chamber 32 to spray into cylinder 14.

Just prior to the instant that termination of injection is desired, input current to electrical circuit 70 should be shut off. As the electrical current and corresponding solenoid forces decay, second electrical actuator 36 becomes sufficiently de-energized to allow armature 34 and valve member 38 to begin to move back toward their down position under the force of biasing spring 35. Fluid communication between needle control passage 31 and needle control chamber 45 is reestablished, and the force of biasing spring 40 and the hydraulic force again acting on closing hydraulic surface 41 can force needle valve member 39 down to close nozzle outlets 42, ending fuel injection. Because the current necessary to actuate second electrical actuator 36 is preferably greater than the current necessary to actuate first electrical actuator 21, second electrical actuator 36 should de-activate before first electrical actuator 21. When the current in electrical circuit 70 and corresponding solenoid force associated with first electrical actuator 21 fall sufficiently, the force of biasing springs 25 and 26 move armature 23 and valve member 27 down, to reestablish fluid communication between fluid supply conduit 28 and fuel tank 17 via spill passage 18. As a result, the remaining fluid pressure in the system can dissipate, allowing the injection cycle to start over again.

Referring to FIG. 2, the various components of this second embodiment of the present invention are shown in the positions they would occupy between injection events. High pressure fluid is continuously supplied to engine 110 and its engine auxiliary system 115 from high pressure supply 111. As in the preferred embodiment, no current is supplied to electrical circuit 170 between injection events. In this state, first electrical actuator 132 is de-energized, and armature 134 and valve member 138 are held in their right position by biasing spring 135. Valve member 138 allows fluid communication between drain passage 160 and pressure control passage 159. Because pressure communication passage 156 is blocked from fluid communication with high pressure passage 112, low pressure is supplied to fuel pressurizer 150 and the force of biasing spring 154 can hold plunger 152 in its retracted position. With plunger 152 in its retracted position, pressurization chamber 151 should be at a relatively low pressure. Nozzle supply passage 129 nozzle chamber 137, and needle control chamber 145 should likewise be at a relatively low pressure.

Between injection events, with the current supply at zero, second electrical actuator 121 is also de-energized. Armature 123 and valve member 127 are in their down position, allowing fluid communication between nozzle supply line 129 and needle control passage 128. Fluid supply conduit 128 thus provides needle control chamber 145 with fuel fluid. The hydraulic force acting on needle closing hydraulic surface 141 and the force of biasing spring 140 hold needle valve member 139 down, closing nozzle outlets 142.

When the beginning of an injection cycle is desired, current is supplied to electrical circuit 170 which is sufficient to actuate first electrical actuator 132, but possibly not sufficient to actuate second electrical actuator 121. In a manner similar to that described with respect to the preferred embodiment, the current may be reduced from its pull-in level to a hold-in level when appropriate. When the current is supplied to coil 133, armature 134 and valve member 138 are pulled toward their left position, opening fluid communication between pressure control passage 159 and high pressure passage 112. High pressure fluid supplied to pressure communication passage 159 acts on piston 153, driving plunger 152 down to pressurize fuel in pressurization chamber 151. Because needle valve member 139 is held down to close nozzle outlets 142, pressure in nozzle chamber 137 can build to an injection pressure.

Just prior to the moment at which initiation of fuel injection is desired, the current level in electrical circuit 170 is raised to a relatively high level. This can be down simultaneous with initial current or at some time thereafter to produce a variety of front end rate shaping effects. In a fashion similar to the preferred embodiment, current may be reduced from a pull-in level to a hold-in level. Electrical current to coil 122 causes armature 123 and valve member 127 to move toward their up position, opening fluid communication between fluid supply conduit 128 and vent passage 114. This causes a relatively sudden drop in pressure in fluid supply conduit 128 and, consequently, in needle control chamber 145. This decrease in pressure results in a decrease in the force acting on closing hydraulic surface 141. The force on opening hydraulic surfaces 143 can overcome the force of biasing spring 140 to move needle valve member 139 up, opening nozzle outlets 142 and allowing fuel to spray into cylinder 14.

When termination of injection is desired, the current to electrical circuit 170 should be shut off. The decay of the current and resulting decay of solenoid forces first causes second electrical actuator 121 to de-activate, followed by the de-activation of first electrical actuator 132. As armature 123 and valve member 127 return to their down positions under the force of biasing spring 125, fluid communication between vent passage 114 and fluid supply conduit 128 is shut off. At the same time, fluid communication is reestablished between fluid supply conduit 128 and nozzle supply line 129, resulting in a significant increase in fluid pressure to needle control chamber 145. As the pressure in needle control chamber 145 increases, the hydraulic force on closing hydraulic surface 141 and the force of biasing spring 140 can overcome the force on opening hydraulic surfaces 143 to push needle valve member 139 down, closing nozzle outlets 142 and ending injection. When current in electrical circuit 170 decays sufficiently, first electrical actuator 132 becomes sufficiently de-energized and armature 134 and valve member 138 begin to move toward their right positions. Valve member 138 is moved by the force of biasing spring 135 to its right position, blocking fluid communication between high pressure passage 112 and pressure communication passage 159. The force of return spring 154 can then move plunger 152 and piston 153 back toward their up position, displacing the used hydraulic fluid to drain 117 via passage 160. As plunger 152 moves up, fuel is drawn into pressurization chamber 151 via inlet 149 from fuel supply 17 in preparation for another injection cycle.

Referring to FIG. 3, the third embodiment of the present invention is shown with its various components in the positions they would occupy between injection events. Cam 260 is preferably rotating at half engine speed in order to be in its pumping stroke at about the time of an injection event at that cylinder. Pump line 248 supplies pressurized fuel to fuel supply conduit 228 and spill passage 218. No current is supplied to the system, and thus both first electrical actuator 221 and second electrical actuator 232 are de-energized. Valve member 227 is in its down position, and thus allows displaced fuel from unit pump 246 to drain from spill passage 218 back to the engine fuel tank 17 for re-circulation. With second electrical actuator 232 de-energized, needle control valve member 238 allows fluid communication between needle biasing passage 231 and needle control chamber 245. Thus, the force of biasing spring 240 and the hydraulic force on closing hydraulic surface 241 can hold needle valve member 239 in its down position, closing nozzle outlets 242.

Just prior to the moment at which initiation of an injection event is desired, a relatively low pull in (LP) level of current is supplied to electrical circuit 270 which is sufficient to actuate first electrical actuator 221. Valve member 227 is pulled toward its up position, blocking fluid communication between spill passage 218 and fuel tank 17. The continuous action of unit pump 246 causes the fluid pressure in the system to rise significantly. When the system has reached the desired injection pressure, the current in electrical circuit 270 may be raised to a level sufficient to actuate second electrical actuator 232. Like the previously discussed embodiments, current may be reduced to a hold-in level from a pull-in level to improve engine energy efficiency. But more importantly, reducing current prevents overheating of electrical components and reduces the size of the boost voltage power supply. When second electrical actuator 232 is actuated, valve member 238 is pulled toward its up position, blocking fluid communication between needle biasing passage 231 and needle control chamber 245. Like the preferred embodiment, the present embodiment preferably employs a controlled leakage from needle control chamber 245, allowing the pressure to bleed off, and the force on opening hydraulic surfaces 243 to push needle valve member 239 up to open nozzle outlets 242.

Just prior to the desired termination of an injection event, current to electrical circuit 270 should be shut off. As the current level drops, second electrical actuator 232 de-energizes, allowing armature 234 and valve member 238 to move back toward their down position, once again allowing pressurized fluid from needle biasing passage 231 and the force of biasing spring 240 to push needle valve member 239 down, closing nozzle outlets 242 and ending fuel injection. As the current decays further, first electrical actuator 221 is de-energized sufficiently to allow armature 223 and valve member 227 to return to their down position under the force of biasing springs 225 and 226. As valve member 227 reopens fluid communication between spill passage 218 and fuel tank 17, fluid pressurized by unit pump 246 can once more drain out of the system 220. The pressure in fuel supply conduit 228 drops significantly, with a concomitant decrease in the fluid pressure in nozzle supply passage 251 and nozzle chamber 236.

Referring to FIGS. 4*a* and 4*b*, there are shown a set of graphs representing the current level, I (HP=high-pull; HH=high-hold; LP=low-pull; LH=low-hold) versus time "T" during an injection event, and the mass flow rate "Q" over time "T" during an example split injection for all embodiments of the present invention. The injection event illustrated in FIGS. 4*a* and 4*b* represents a relatively small pilot injection followed by a relatively large main injection, or split injection, although it should be appreciated that a variety of injection rate shapes and injection types for varying operating conditions might be possible with the present invention. For instance, a ramp or single square injection might be desirable rather than the split injection shown. As illustrated in FIG. 4*a*, an injection event is initiated by applying a first pull-in current at a level LP to the electrical circuit to move the armature of the first electrical actuator toward the solenoid stator. The current supplied to the electrical circuit is then reduced to a first hold-in current level LH, requiring significantly less energy consumption. This action allows fuel pressure in the system to begin rising to injection pressure levels. The magnitudes of the LP and LH current levels are preferably selected such that the magnetic forces developed thereby on the armature of the first electrical actuator are sufficient to overcome the biasing force of the biasing spring(s) acting on the armature.

However, the magnitudes of the LP and LH currents are preferably such that the magnetic forces developed on the armature of the second electrical actuator at the LP and LH current levels are insufficient to overcome the force of its biasing spring.

When it is desirable to open the injector's nozzle outlets for fuel injection, for example in the pilot injection shown in FIGS. 4*a* and 4*b*, the current is increased to a relatively high pull-in level HP to move the second electrical actuator's armature to its solenoid stator. The current to the electrical circuit may then be reduced to a relatively lower level HH to allow completion of the desired amount of pilot injection. After the pilot injection, current is reduced once again to the LH level, allowing the armature of the second electrical actuator to move toward its de-energized position, terminating the pilot injection. In the injection scheme illustrated in FIGS. 4*a* and 4*b*, the current supplied to the electrical circuit should be maintained at a level that is sufficient for the first electrical actuator to remain energized, its armature continuing to be held against the solenoid stator, allowing pressure in the system to be sustained at the desired injection pressure. When main injection is desired, the current is once again increased to a level HP sufficient to actuate the second electrical actuator, then reduced to the relatively lower level HH. When termination of main injection is desired, the current in the electrical circuit is preferably shut off entirely. However, it may be desirable to have a LH current at the end of injection in order to assure that the needle valve closes before the spill valve closes to prevent end of injection variability. Finally, instead of different pull-in currents, one pull in current with different current duration could possibly be used.

By combining the operating benefits of a dual solenoid injector with the disclosed single circuit design, the present invention allows precise control over injection timing and fuel pressurization, while reducing excess hardware, such as wiring, and enhancing system robustness. The multi-level current scheme for selectively actuating the two solenoids might find application in other areas, or in improved versions of the present invention. For instance, actuators used in other engine systems might be wired in series with the actuators from the present invention. In this manner, numerous engine systems such as an engine brake and a fuel injector, might be operated on a single circuit by varying and possibly reversing the current levels, resulting in a substantial improvement in engine efficiency and overall system robustness, as well as decreased production and maintenance costs.

Thus, those skilled in the art will appreciate that other aspects, objects and advantages of this invention can be obtained from a study of the drawings, the disclosure and the appended claims

What is claimed is:

1. An engine comprising:

an engine housing defining at least one cylinder;

at least one engine auxiliary system attached to said engine housing and having a different portion associated with each of said at least one cylinder, and each said different portion including a first electrical actuator operably coupled to a first valve and a second electrical actuator operably coupled to a second valve;

an electrical circuit associated with each of said at least one cylinder; and said first electrical actuator and said second electrical actuator being arranged in series on said electrical circuit and being actuatable at a low current level and a high current level, respectively, and said first and second electrical actuators being oriented on different centerlines.

2. The engine of claim 1 wherein said at least one auxiliary system includes a fuel injection system;

said first valve being a portion of a fuel pressurizer; and said second valve being a portion of a direct operated needle valve.

3. The engine of claim 2 wherein said second electrical actuators attached to a needle control valve member.

4. The engine of claim 3 wherein said first valve is a flow control valve.

5. The engine of claim 4 wherein said fuel injection system includes at least one hydraulically actuated fuel injector with an intensifier piston; and said flow control valve being operable to control fluid flow to said intensifier piston.

6. The engine of claim 4 wherein said fuel injection system includes a plurality of mechanically actuated fuel injectors, each defining a fuel pressurization chamber; and said flow control valve being operable to open and close said fuel pressurization chamber to a spill passage.

7. The engine of claim 3 wherein said fuel pressurizer includes a unit pump;

said direct operated needle valve is a portion of a nozzle assembly separated from said unit pump; and said unit pump being fluidly connected to said nozzle assembly by a fluid supply conduit.

8. The engine of claim 7 wherein said supply conduit is a fuel supply conduit.

9. A fuel injection system comprising:

at least one body component;

a first electrical actuator being operably coupled to a fuel pressurizer;

a second electrical actuator being operably coupled to a direct control needle valve;

said first electrical actuator and said second electrical actuator being arranged in series on an electrical circuit and being actuatable at a low current level and a high current level, respectively; and said first, electrical actuator, said fuel pressurizer, said second electrical actuator, and a nozzle needle valve being attached to said at least one body component., and said first and second electrical actuators being oriented on different centerlines.

10. The fuel injection system of claim 9 wherein said second electrical actuator is attached to a needle control valve member.

11. The fuel injection system of claim 10 wherein said first electrical actuator is operably coupled to a flow control valve.

12. The fuel injection system of claim 11 wherein said first electrical actuator, said fuel pressurizer, said second electrical actuator, and a nozzle needle valve are attached to a unit injector body.

13. The fuel injection system of claim 12 including an intensifier piston positioned in said unit injector body; and said flow control valve being operable to control fluid flow to said intensifier piston.

14. The fuel injection system of claim 12 including a cam actuated plunger attached to said unit injector body, and defining a portion of a fuel pressurization chamber; and said flow control valve being operable to open and close said fuel pressurization chamber to a spill passage.

15. The fuel injection system of claim 12 wherein said fuel pressurizer includes a unit pump;

said direct control needle valve is a portion of a nozzle assembly separated from said unit pump; and said unit pump being fluidly connected to said nozzle assembly by a fluid supply conduit.

16. The fuel injection system of claim 15 wherein said supply conduit is a fuel supply conduit.

17. A method of controlling a portion of at least one engine auxiliary system associated with each engine cylinder, comprising the steps of:

arranging a first electrical actuator and a second electrical actuator on different centerlines but in series on an electrical circuit associated with each engine cylinder;

actuating the first electrical actuator without actuating the second electrical actuator at least in part by establishing a relatively low current level in the electrical circuit; and actuating the second electrical actuator at least in part by establishing a relatively high current level in the electrical circuit.

18. The method of claim 17 including a step of resetting the first electrical actuator and the second electrical actuator at least in part by reducing a current level in the electrical circuit below the relatively low current level.

19. The method of claim 18 wherein said step of actuating the first electrical actuator includes a step of pressurizing fuel for a fuel injection event.

20. The method of claim 19 wherein said step of actuating the second electrical actuator includes a step of opening a nozzle to inject fuel into an engine cylinder.

* * * * *

UNITED STATES PATENT AND TRADEMARK OFFICE

CERTIFICATE OF CORRECTION

PATENT NO. : 6,684,854 B2
DATED : February 3, 2004
INVENTOR(S) : Dana R. Coldren et al.

It is certified that error appears in the above-identified patent and that said Letters Patent is hereby corrected as shown below:

Title page,
Item [57], ABSTRACT, line 2, after "at" insert -- least one cylinder. At least one engine auxiliary system is attached to the engine --.

Signed and Sealed this

Eighth Day of June, 2004

JON W. DUDAS
*Acting Director of the United States Patent and Trademark Office*